US008069984B2

(12) United States Patent
Larson et al.

(10) Patent No.: US 8,069,984 B2
(45) Date of Patent: Dec. 6, 2011

(54) BIT HOLDER

(75) Inventors: Matthew Steven Larson, Cornelius, NC (US); Derek James Nash, Huntersville, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 161 days.

(21) Appl. No.: 12/536,825

(22) Filed: Aug. 6, 2009

(65) Prior Publication Data

US 2011/0031145 A1 Feb. 10, 2011

(51) Int. Cl.
*B65D 85/20* (2006.01)

(52) U.S. Cl. ..... 206/377; 206/379; 206/372; 211/69

(58) Field of Classification Search ..... 206/377, 206/379, 378, 443, 372, 373, 349, 562, 563, 206/564; 211/70.6, 69, 69.5
See application file for complete search history.

(56) References Cited

U.S. PATENT DOCUMENTS

| | | | | |
|---|---|---|---|---|
| 4,487,316 | A * | 12/1984 | Calhoun et al. | 206/443 |
| 6,112,897 | A * | 9/2000 | Hu | 206/377 |
| 6,213,296 | B1 * | 4/2001 | Streich et al. | 206/373 |
| D477,714 | S | 7/2003 | Cunningham et al. | |
| D477,912 | S | 8/2003 | Cunningham et al. | |
| D481,868 | S | 11/2003 | Cunningham et al. | |
| D497,105 | S | 10/2004 | Trettin | |
| D497,800 | S | 11/2004 | Trettin | |
| D505,068 | S | 5/2005 | Cunningham et al. | |
| 7,195,120 | B2 | 3/2007 | Cunningham et al. | |
| 7,225,923 | B2 | 6/2007 | Hallee et al. | |
| 7,322,470 | B2 * | 1/2008 | Brunson | 206/372 |
| 7,325,682 | B2 | 2/2008 | Seymour et al. | |
| 7,600,640 | B2 * | 10/2009 | Hallee et al. | 206/373 |
| 7,726,479 | B2 * | 6/2010 | Vasudeva | 206/379 |
| 2005/0150848 | A1 * | 7/2005 | Hun | 211/69 |
| 2005/0241974 | A1 * | 11/2005 | Chen | 206/379 |

* cited by examiner

*Primary Examiner* — David Fidei
(74) *Attorney, Agent, or Firm* — Dennis J. Williamson; Moore & Van Allen, PLLC

(57) ABSTRACT

A bit holder comprises a body defining at least one cavity. The cavity includes a first pathway for receiving a bit and a second pathway for holding a bit. The first and second pathways intersect to define an open area between the first pathway and the second pathway such that a bit can be rotated between the first pathway and to a locked position in second pathway. The first pathway is disposed at an angle relative to the second pathway. The bit is retained by an interference fit with the body. The holder may be releasably retained in a case using mating structures on the case and holder. In a method for retaining a bit in a holder, the bit is inserted into the holder along the first pathway. The bit is rotated through the open area to position the bit in the second pathway where it is held.

16 Claims, 15 Drawing Sheets

BIT HOLDER

The invention relates generally to holders and more particularly to a holder for bits or other elongated articles.

BACKGROUND

Drills typically include a chuck that releasably holds a bit such as a drill bit, screwdriver bit, socket or other tool. The bits are often sold in sets where selected bits are inserted into and removed from the chuck as required by the user. The bits may be retained in the sets in holders that releasably hold the bits when not in use. In the known holders the bits are either too difficult to properly insert into the holder or the holder does not securely retain the bit. The holders also do not efficiently utilize space.

SUMMARY OF THE INVENTION

A bit holder comprises a body defining at least one cavity. The cavity includes a first pathway for receiving a bit and a second pathway for holding the bit. The first and second pathways intersect to define an open area between the first pathway and the second pathway such that a bit can be rotated from the first pathway to a locked position in second pathway. The first pathway is disposed at an angle relative to the second pathway. The bit is retained by an interference fit with the body. The holder may be releasably retained in a case using mating structures on the case and holder. A method is also provided for retaining a bit in a holder where a bit is inserted into the holder along the first pathway. The bit is rotated through the open area to position the bit in the second pathway.

DETAILED DESCRIPTION OF PREFERRED EMBODIMENTS OF THE INVENTION

Figure 1:
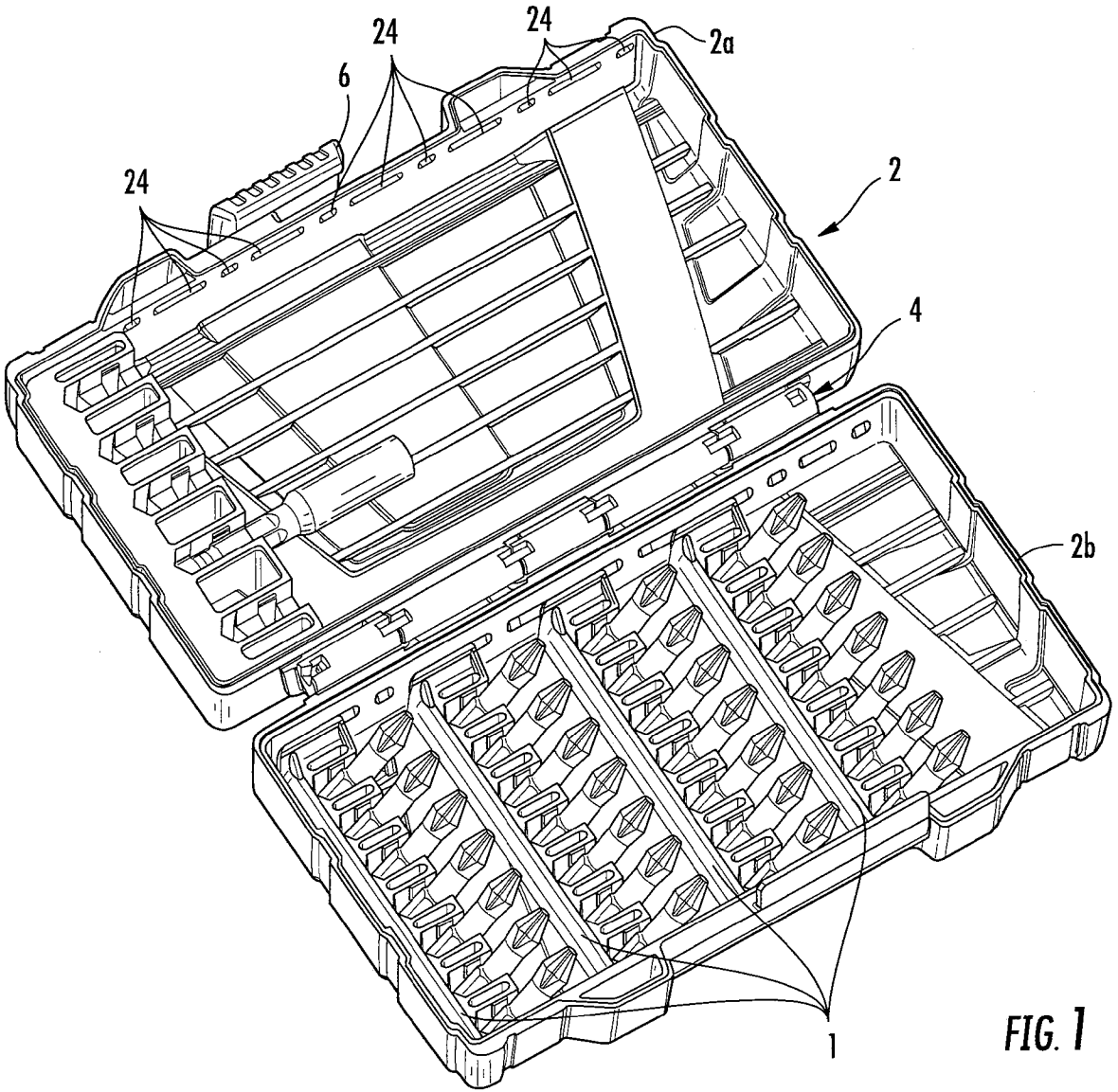
FIG. 1 is an embodiment of a drill bit case with an embodiment of the bit holder of the invention.
Figure 2:
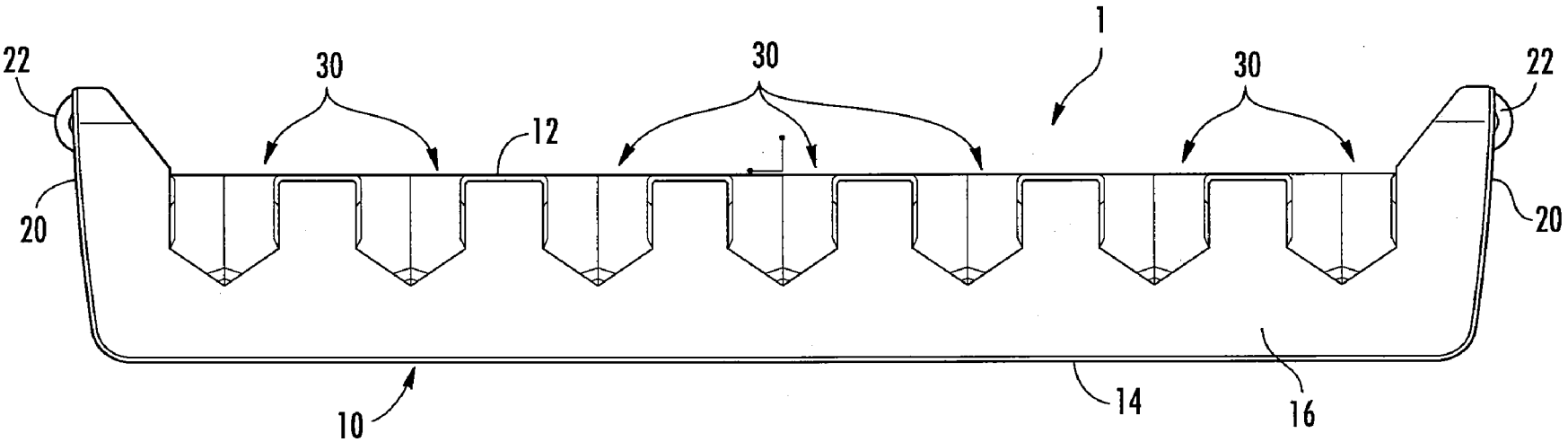
FIG. 2 is a front view of the holder of FIG. 1.

Referring to FIG. 1 embodiments of the bit holder of the invention are shown located in a case 2. Case 2 comprises a top section 2*a* that is pivotably attached to a bottom section 2*b* at hinge 4 such that the sections can be pivoted from the illustrated open position to a closed position. A lock 6 may be provided for releasably securing the top section 2*a* to the bottom section 2*b*. The top section 2*a* and bottom section 2*b* may each hold one or more of the holders. In one embodiment the bit holders are releasably secured in the case 2. While a specific embodiment of a case is shown, the case may take a wide variety of other forms. Further, the bit holder may be used without a case.

Bit holder 1 includes a body 10 having a top surface 12 spaced from a substantially parallel bottom surface 14. The body 10 further includes a front surface 16 spaced from a substantially parallel back surface 18 where the front and back surfaces extend between the top surface 12 and bottom surface 14 to define a substantially rectangular block. An end wall 20 extends from each end of the body 10 and includes protrusions 22. The end walls 20 can flex relative to the body such that the protrusions 22 can releasably engage recesses 24 formed on a side wall of case 2. The holder 1 extends between sidewalls of the case 2 such that end walls 20 can flex when the holder 1 is pushed into the case 2 and protrusions 22 can engage opposed recesses 24. The end walls 20 can be flexed inwardly by a user to disengage the protrusions 40 from the cavities 24 such that the holder can be removed from case 2.

A plurality of receptacles 30 are formed in the holder 1 for receiving bits 32. Each receptacle 30 is formed as a cavity 34 in the body. In the illustrated embodiment the cavity 34 extends all of the way through the body such that the body is open along the top surface 12 and bottom surface 14; however, the cavity may be closed along its bottom such that it is open only toward the top surface 12. The cavity 34 extends through a portion of the top surface 12 and a portion of the front surface 16. The cavity 34 is formed, in part, by a pair of opposed sidewalls 35.

The cavity 34 is formed of two intersecting pathways dimensioned to receive a bit. The first pathway 33 extends along axis A-A and is disposed generally perpendicularly to the top surface 12. The pathway 33 is formed, in part, by a back wall 36 that is dimensioned and shaped to receive an end of the bit 32. A typical bit 32 is formed with a connector portion 32*a* on a first end that is configured to fit into a chuck of a tool of a tool. With such a bit, the wall 36 is configured in a mating shape to create receiver into which the bit is closely received. In the illustrated embodiment the bit 32 is formed with a hexagonal connector portion 32*a*. For bits having first ends with a different cross-sectional shape the receiver is configured to closely receive that shape. The wall 36 includes a downwardly extending free end 36*a*. The flexible end 36*a* may be created by extending the wall in a cantilevered fashion from body 10.

The second pathway 37 extends along axis B-B and is disposed at an angle relative to the first pathway 33. The second pathway 37 is defined in part by a bottom wall 39 that is configured to have a mating shape for receiving the connector portion 32*a* and/or shaft portion 32*b* of the bit 32. The bottom wall 39 has a free end 39*a* that is able to flex slightly. The flexible end 39*a* may be created by extending the wall in a cantilevered fashion from body 10. The protrusions 40 may have a slight interference fit with the bit when the bit is inserted along pathway 37.

The area between the pathways 33 and 37 is open. Protrusions 40 are formed on the side walls 35 in the transition area between the first pathway 33 and second pathway 37. The protrusions 40 are arranged opposite one another to create a constricted space therebetween. As the bit is inserted into or removed from the holder, the side walls 35 flex slightly to increase the spacing between the protrusions 40 to allow a bit to fit therebetween. To allow the side walls 35 to flex during insertion and removal of a bit into the holders, a gap or space 42 is created between the sidewalls of adjacent cavities. This allows the side wall 35 of one cavity to flex without affecting the side wall of the adjacent cavity.

Figure 3:
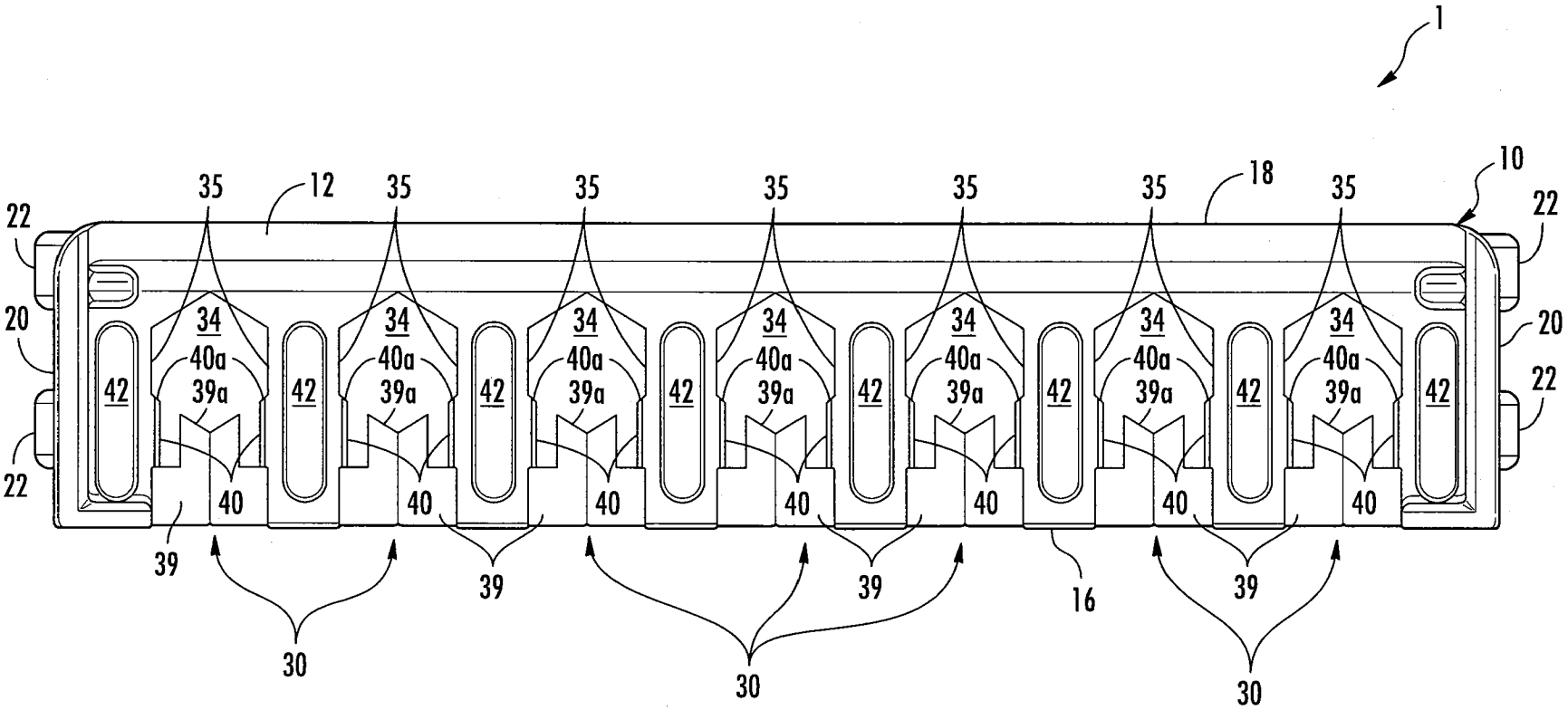
FIG. 3 is a top view of the holder of FIG. 1.
Figure 4:
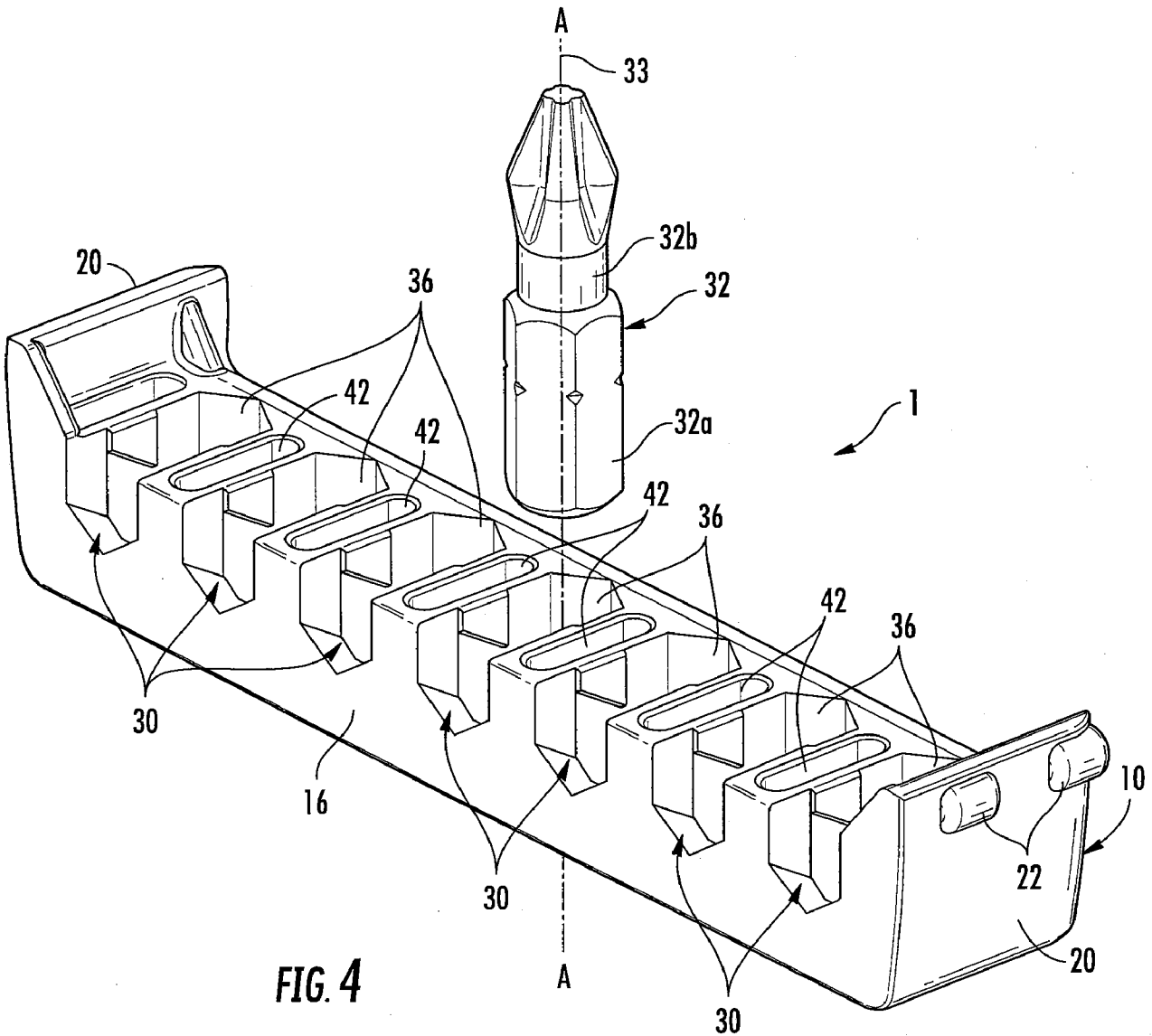
FIG. 4 is a perspective view of the holder of FIG. 1 showing a bit being inserted into a first position in the holder.
Figure 5:
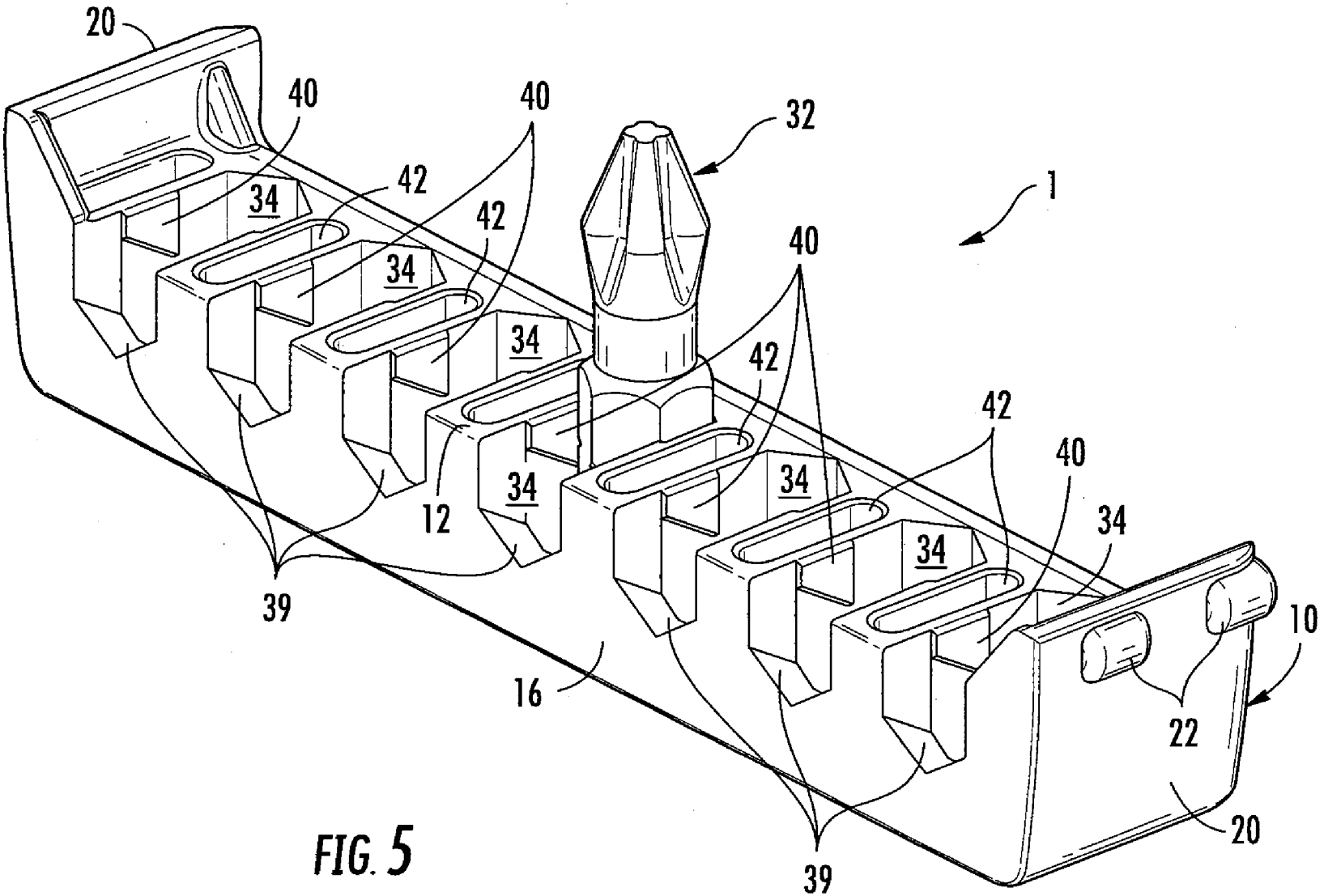
FIG. 5 is a perspective view of the holder of FIG. 1 showing the bit in the first position.
Figure 6:
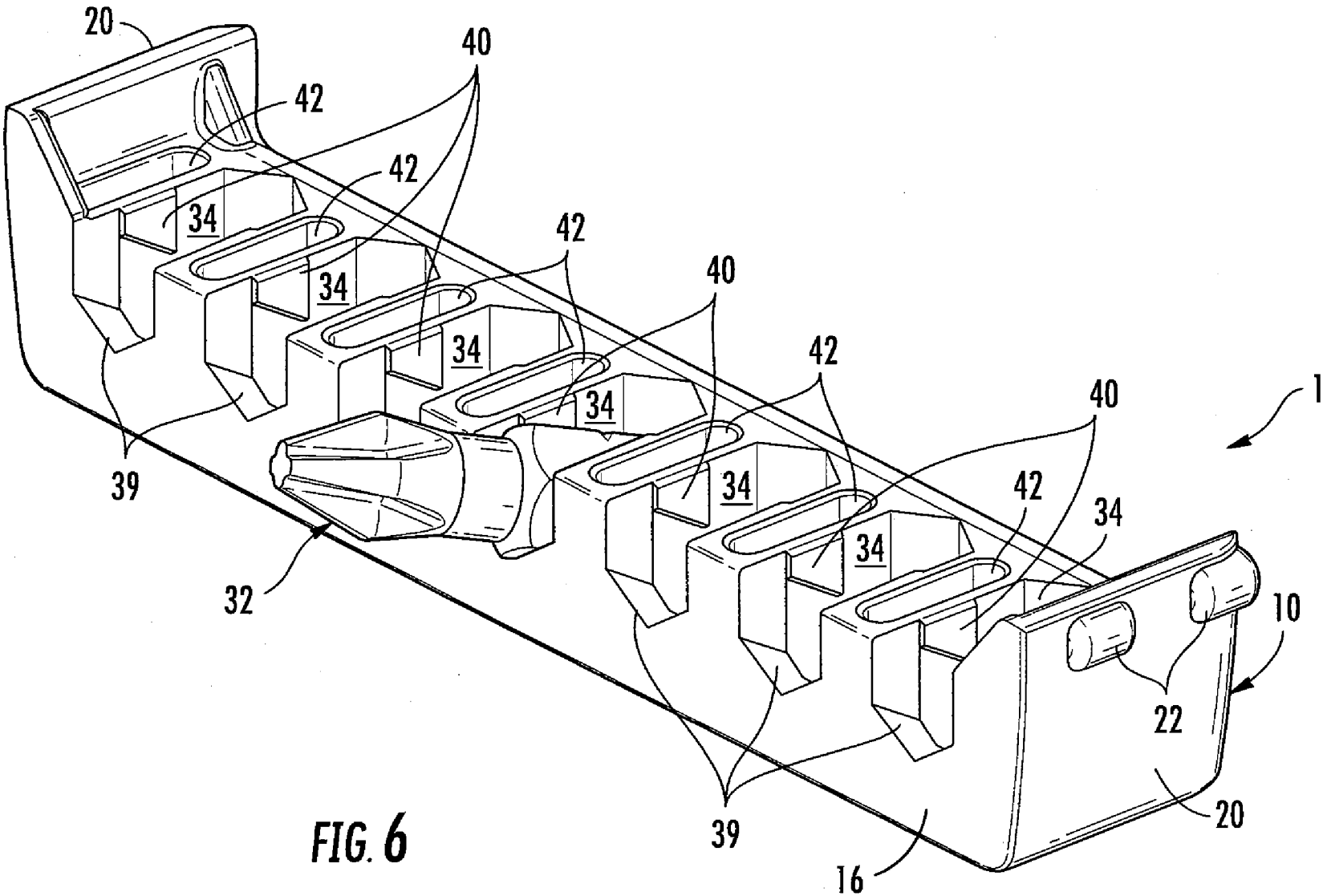
FIG. 6 is a perspective view of the holder of FIG. 1 showing the bit in a second position in the holder.

To insert a bit into the holder, a bit 32 is inserted into the holder along the first pathway 33 defined by axis A-A, FIGS. 4 and 5. The bit is properly oriented and guided into the holder by back wall 36 and side walls 35. The ends 40*a* of protrusions 40 may also be located and configured such that they engage the sides of the bit. Further, the end of bottom wall 39 is also shaped and configured to closely receive the side of the bit 32 as the bit is inserted into cavity 34 along axis A-A. Referring to FIG. 3, the side walls 35, protrusions 40 and the end 39*a* of bottom wall 39 create a receiver having the same cross-sectional shape as the inserted end of bit 32 such that the bit is guided into the proper location in cavity 34. When the bit is fully inserted into cavity 34 along pathway A-A the lower end of the bit is closely adjacent to or abutting the bottom wall 39, the side of the bit is closely adjacent to or abutting the side wall 36 and the front side of the bit is closely adjacent to or abutting the edges 40*a* of protrusions 40.

Figure 7:
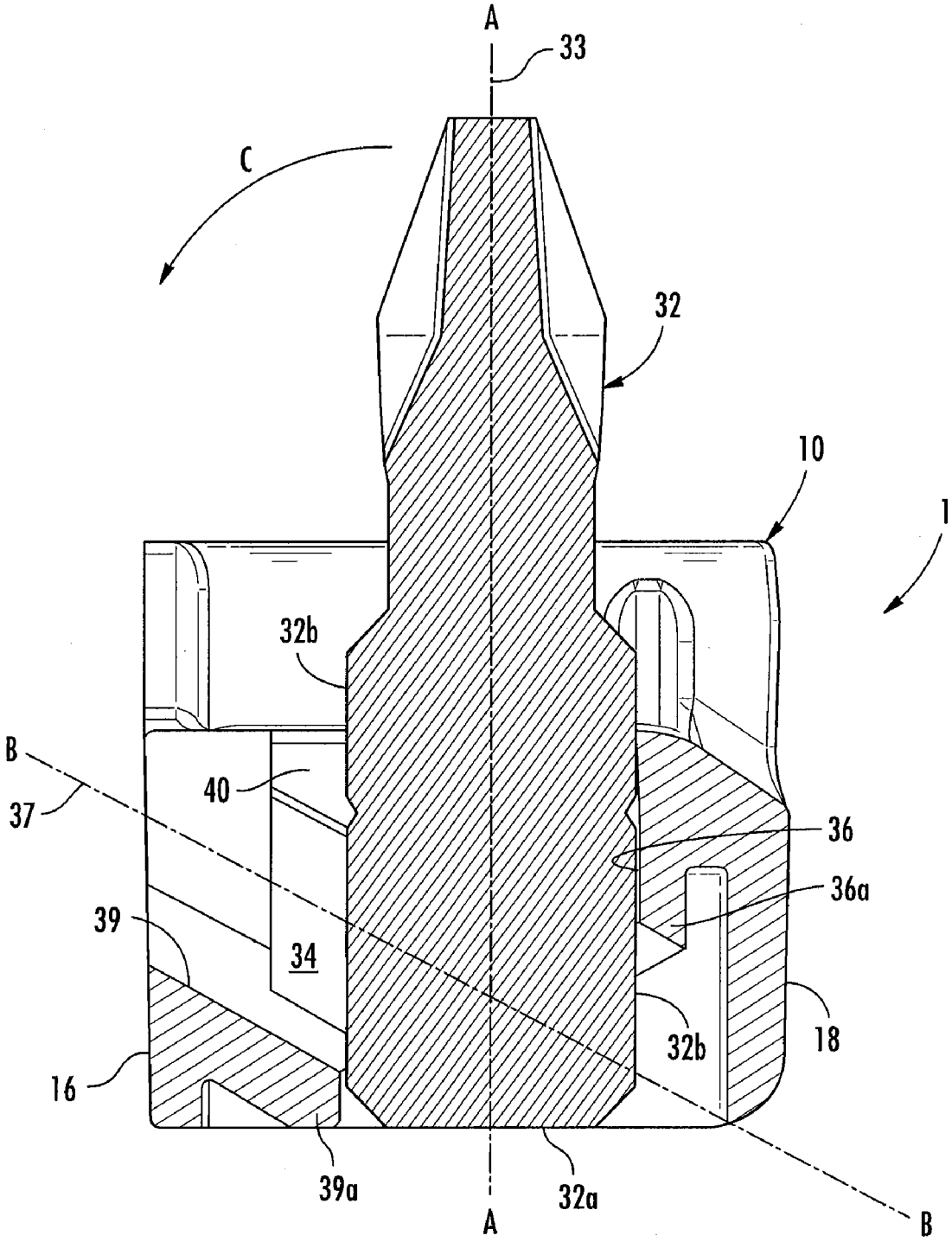
FIG. 7 is a section view of the holder of FIG. 1 with the bit in the first position.
Figure 8:
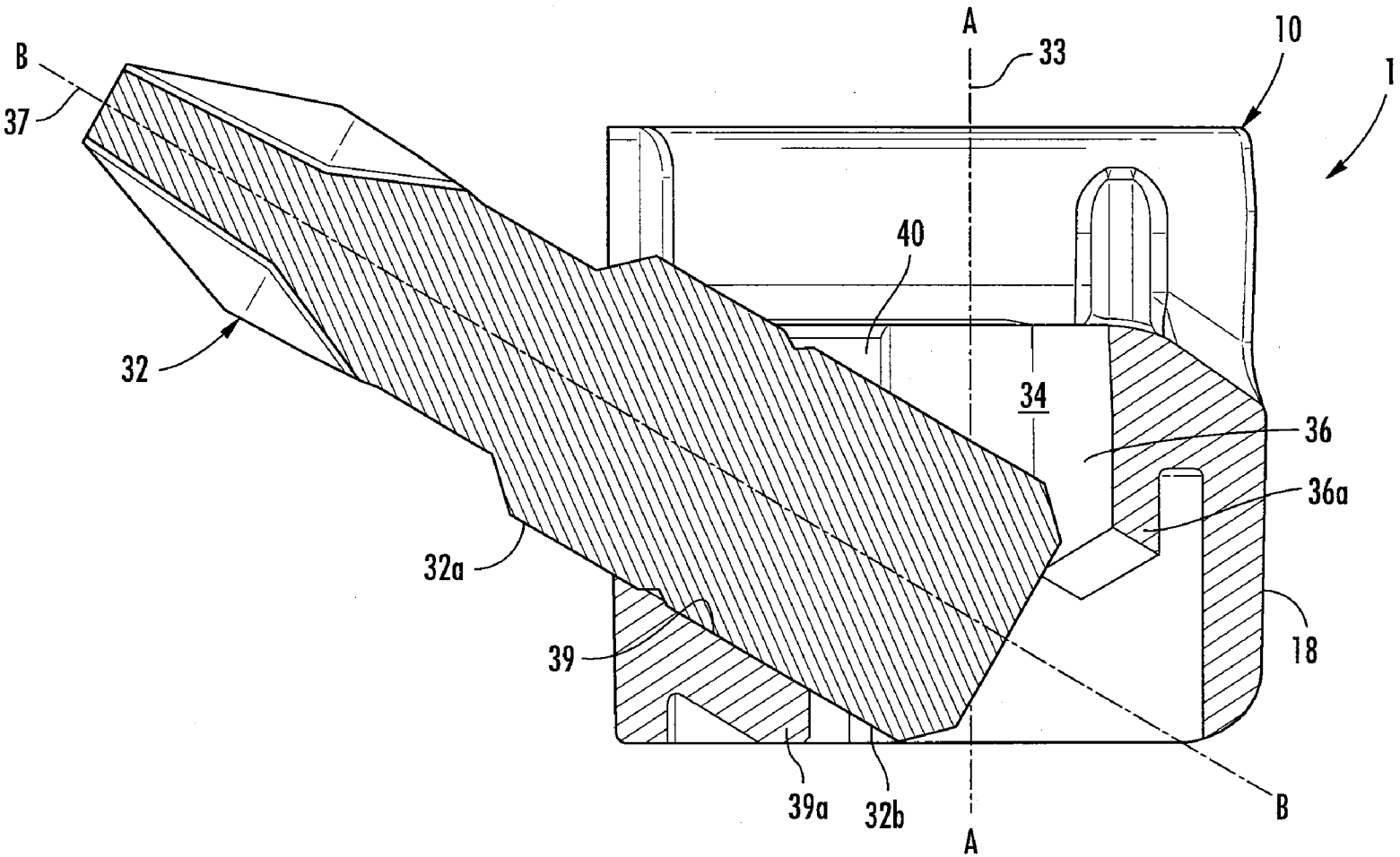
FIG. 8 is a section view of the holder of FIG. 1 with the bit in the second position.
Figure 9:
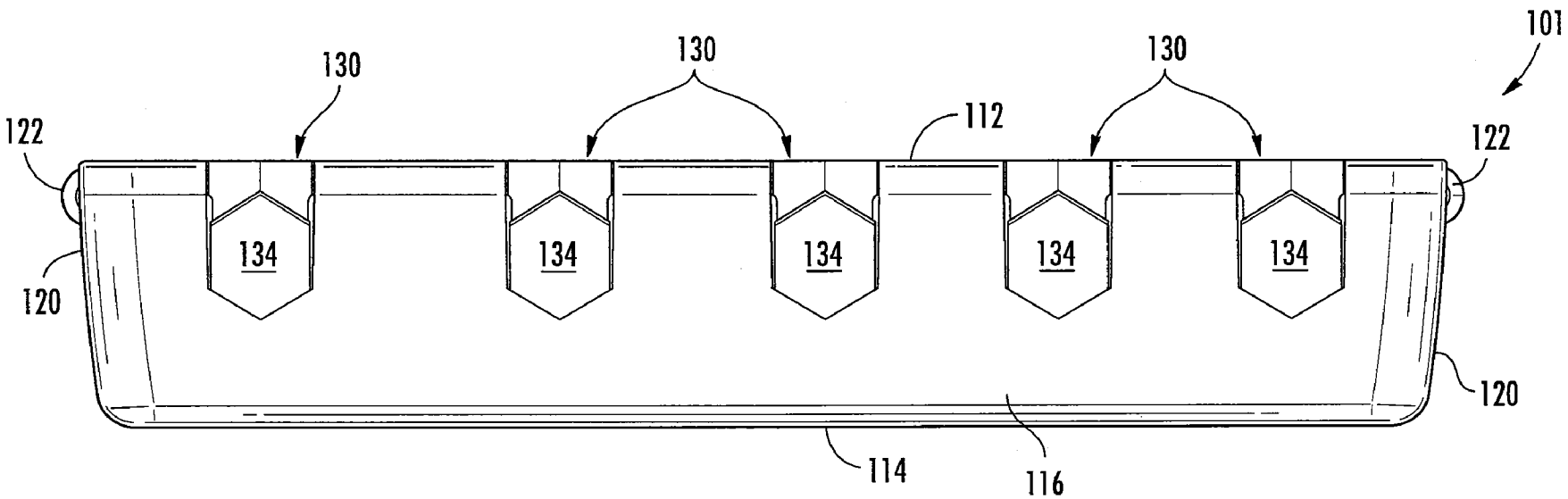
FIG. 9 is a front view of a second embodiment of the holder.
Figure 10:
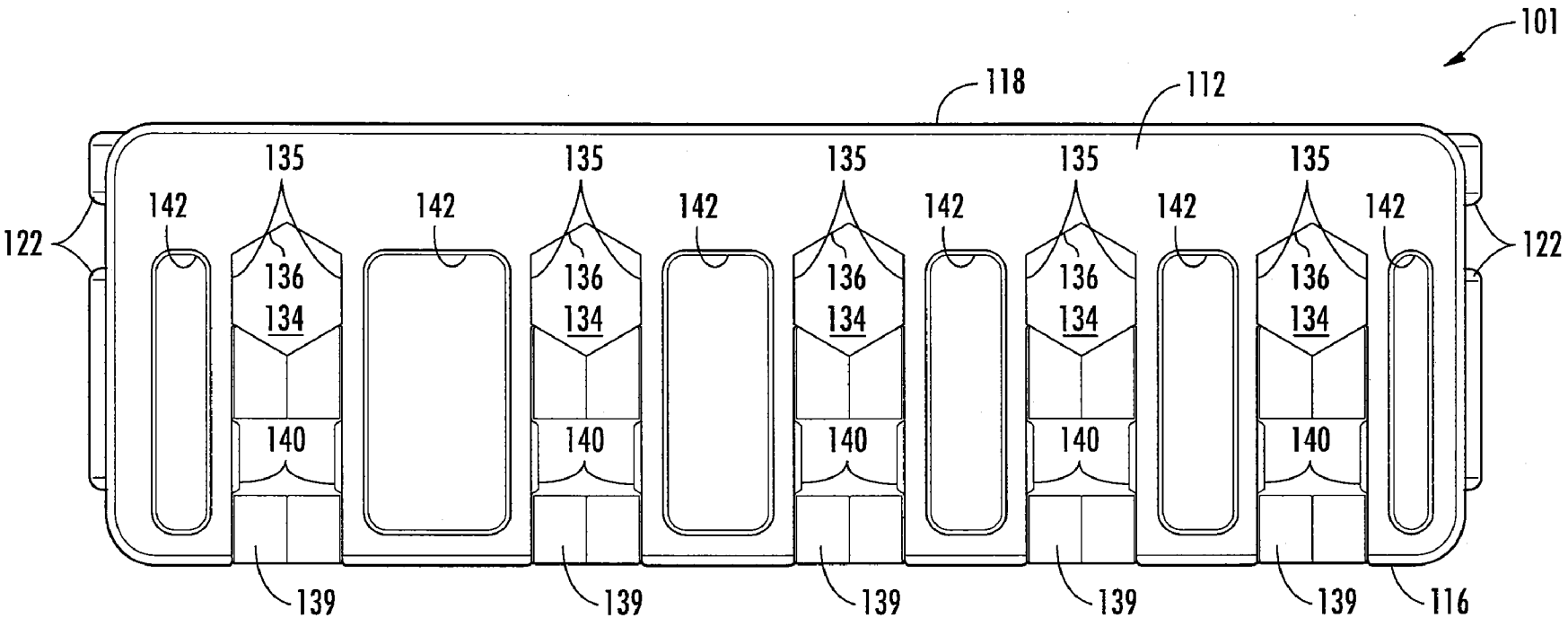
FIG. 10 is a top view of the holder of FIG. 9.
Figure 11:
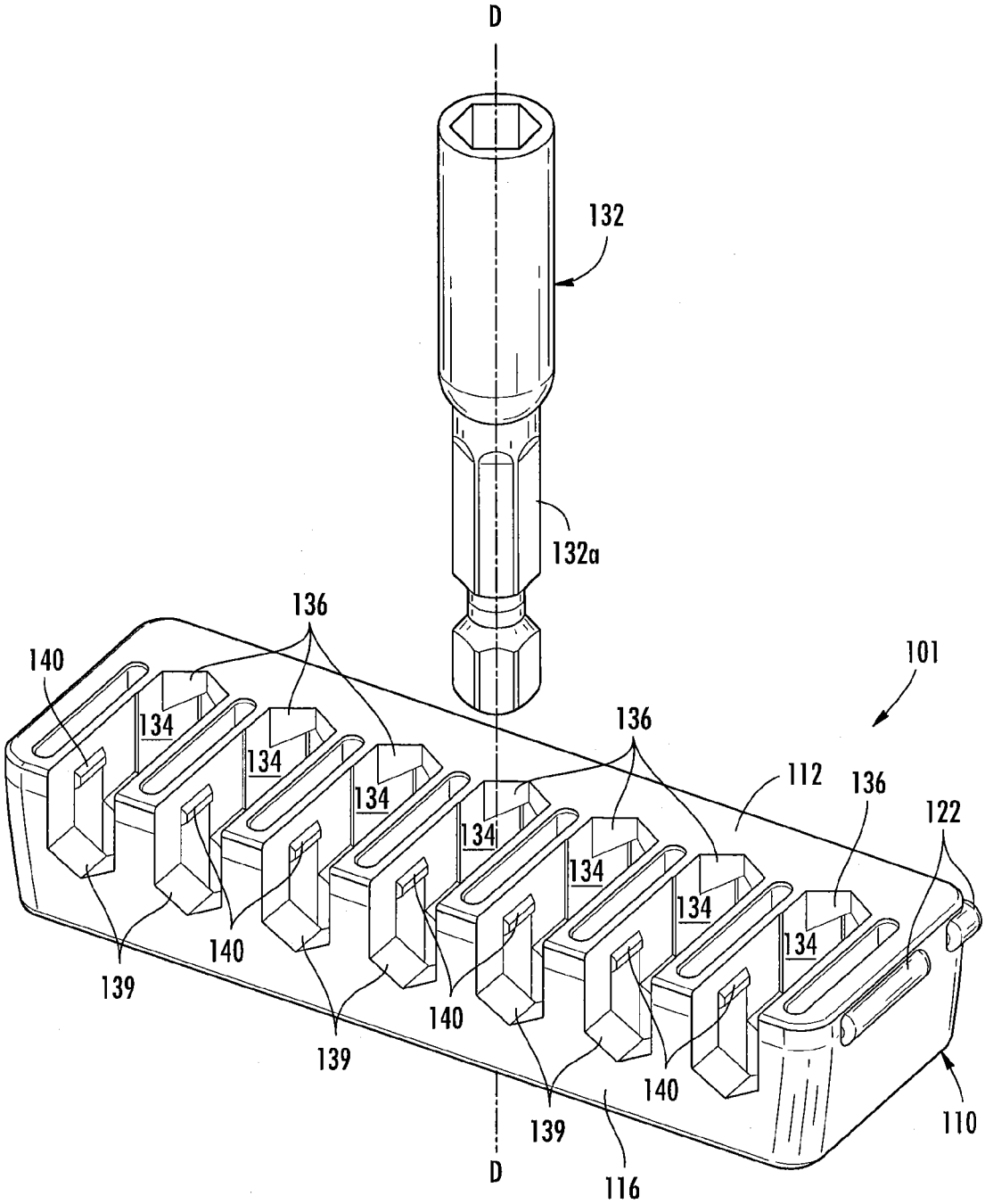
FIG. 11 is a perspective view of the holder of FIG. 9 showing a bit being inserted into a first position in the holder.

Referring to FIG. 7, the user pushes against the exposed end of the bit in the direction of arrow C to rotate the bit in cavity 34. Bit 32 is rotated from a first position where its longitudinal axis extends along axis A-A to a second locked position where its longitudinal axis is disposed along axis B-B. The bit rotates about its distal end 32*c*. As the bit rotates, it is forced between protrusions 40 until it rests against bottom wall 39. The side walls flex away from one another allowing the bit to pass between the protrusions. Once the bit clears the protrusions 40 the side walls 35 return to their normal undeformed state. In this position the space between the protrusions 40 is less than the width of the bit 32 such that the bit is held in the holder. The free end 36*a* of side wall 36 and free end 39*a* of bottom wall 39 may flex slightly during the insertion process allowing the bit clearance to rotate from the first orientation along axis A-A to the locked second orientation along axis B-B. The protrusions 40 and surface 39 create an interference fit with bit 32 to retain the bit in the holder.

To remove the bits the process is reversed. The user pushes against the exposed end of the bit in the direction opposite arrow C to rotate the bit in cavity 34. Bit 32 is rotated from the locked position where its longitudinal axis extends along axis B-B to a position where its longitudinal axis is disposed along axis A-A. As the bit rotates, it is forced between protrusions 40. The side walls flex away from one another allowing the bit to pass between the protrusions. Once the bit clears the protrusions 40 the side walls of the cavity can flex and return to their normal undeformed state. The bit can then be simply removed from the holder along axis A-A.

In the illustrated embodiment the axis A-A is located at an angle of approximately 60 degrees relative to axis B-B. By angling the axes less than 90 degrees relative to one another a space S is created behind the bit such that the adjacent holder can be located partially beneath the locked bit as shown in FIG. 1. This allows the bit holders to be more closely spaced relative to one another in case 2 thereby allowing more bits to be held in a case.

An alternate embodiment of the holder is shown in FIGS. 9 through 15. Bit holder 101 includes a body 110 having a top surface 112 spaced from a substantially parallel bottom surface 114. The body 110 further includes a front surface 116 spaced from a substantially parallel back surface 118 where the side surfaces extend between the top surface 112 and bottom surface 114 to define a rectangular block. An end wall 120 extends from each end of the body 110 and includes protrusions 122. The end walls 120 and/or protrusions 122 can flex relative to the body such that the protrusions 122 can releasably engage mating cavities 24 formed on a side wall of case 2 as previously described.

A plurality of receptacles 130 are formed in the holder 1 for receiving bits 32. Each receptacle 130 is formed as a cavity 34 in the body. In the illustrated embodiment the cavity 134 extends all of the way through the body such that the body is open along the top surface 112 and bottom surface 114; however, the cavity may be closed along its bottom such that it is open only toward the top surface 114. The cavity 134 extends through a portion of the top surface 112 and a portion of the first side surface 116. The cavity 134 is formed, in part, by a pair of opposed sidewalls 135.

The cavity 134 is formed of two intersecting pathways dimensioned to receive a bit. The first pathway 133 extends along axis D-D and is disposed generally perpendicularly to the top surface 112. The pathway 133 is formed, in part, by a wall 136 that is dimensioned and shaped to receive an end of the bit 132. A typical bit 132 is formed with a hexagonal connector portion 132*a* that is configured to fit into a chuck of a tool. With such a bit, the wall 136 is configured in a mating shape to create receiver into which the bit is closely received. For bits having first ends with a different cross-sectional shape the receiver is configured to closely receive that shape.

The second pathway 137 extends along axis E-E and is disposed at an angle relative to the first pathway 133. In this embodiment the axis E-E of the second pathway 137 is at a 90 degree angle relative to the first pathway 133. The second pathway is defined in part by a bottom wall 139 that is configured to have a mating shape for receiving the connector portion 132*a* of the bit 132.

The area between the pathways is open. Protrusions 140 are formed on the side walls 135 in the transition area between the first pathway and second pathway. The protrusions 140 are arranged opposite one another to create a constricted space therebetween. As the bit is inserted into or removed from the holder, the side walls 135 and protrusions 140 flex slightly to increase the spacing between the protrusions to allow a bit to fit therebetween. To allow the side walls 135 to flex during insertion and removal of the bits into the holders, a space 142 is created between the sidewalls of adjacent cavities. This allows the side wall 135 of one cavity to flex without affecting the side wall of the adjacent cavity.

Figure 12:
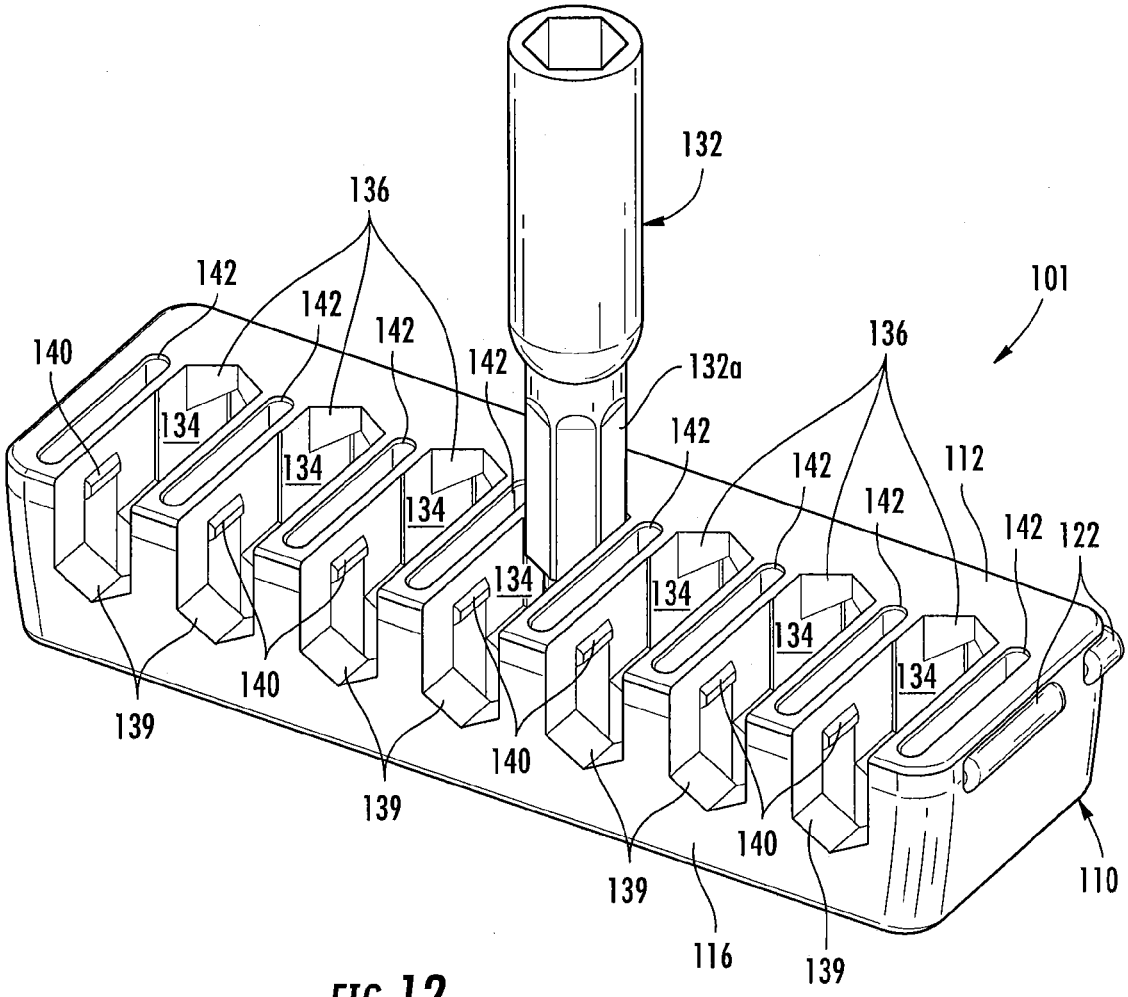
FIG. 12 is a perspective view of the holder of FIG. 9 showing the bit in the first position.
Figure 13:
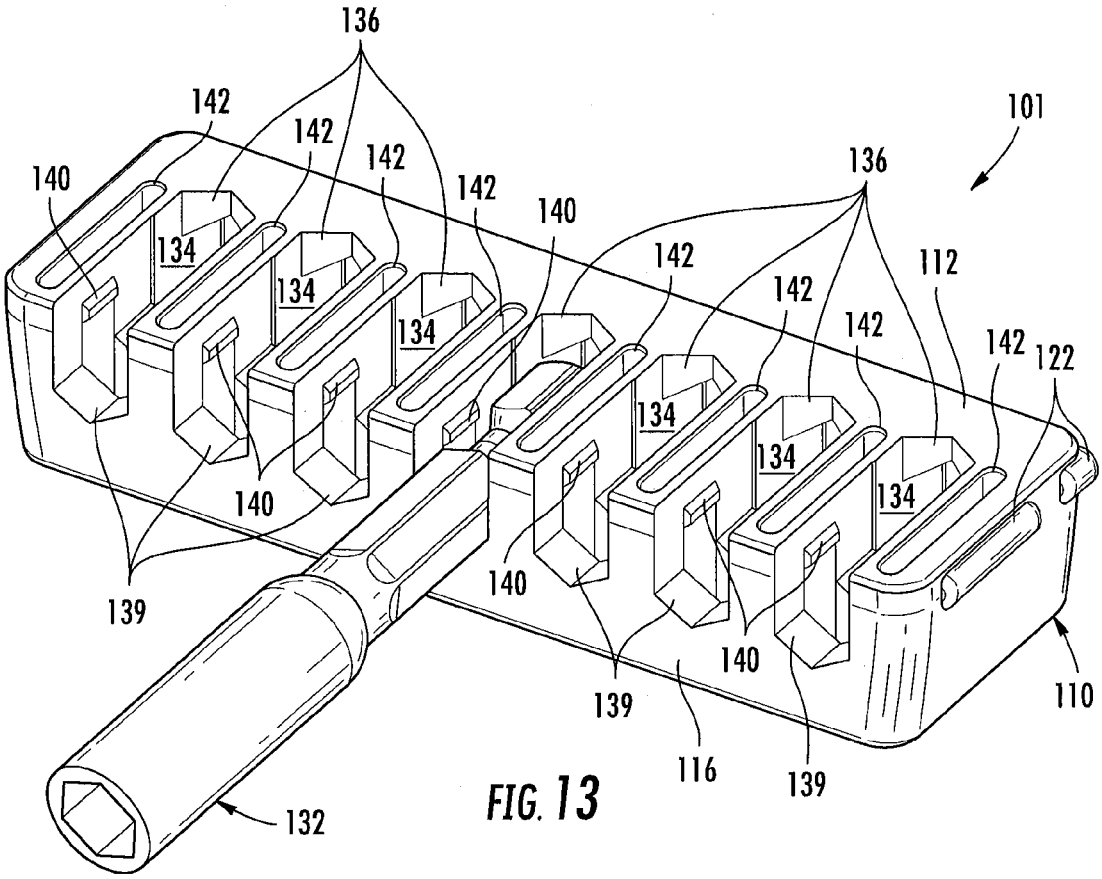
FIG. 13 is a perspective view of the holder of FIG. 9 showing the bit in a second position in the holder.
Figure 14:
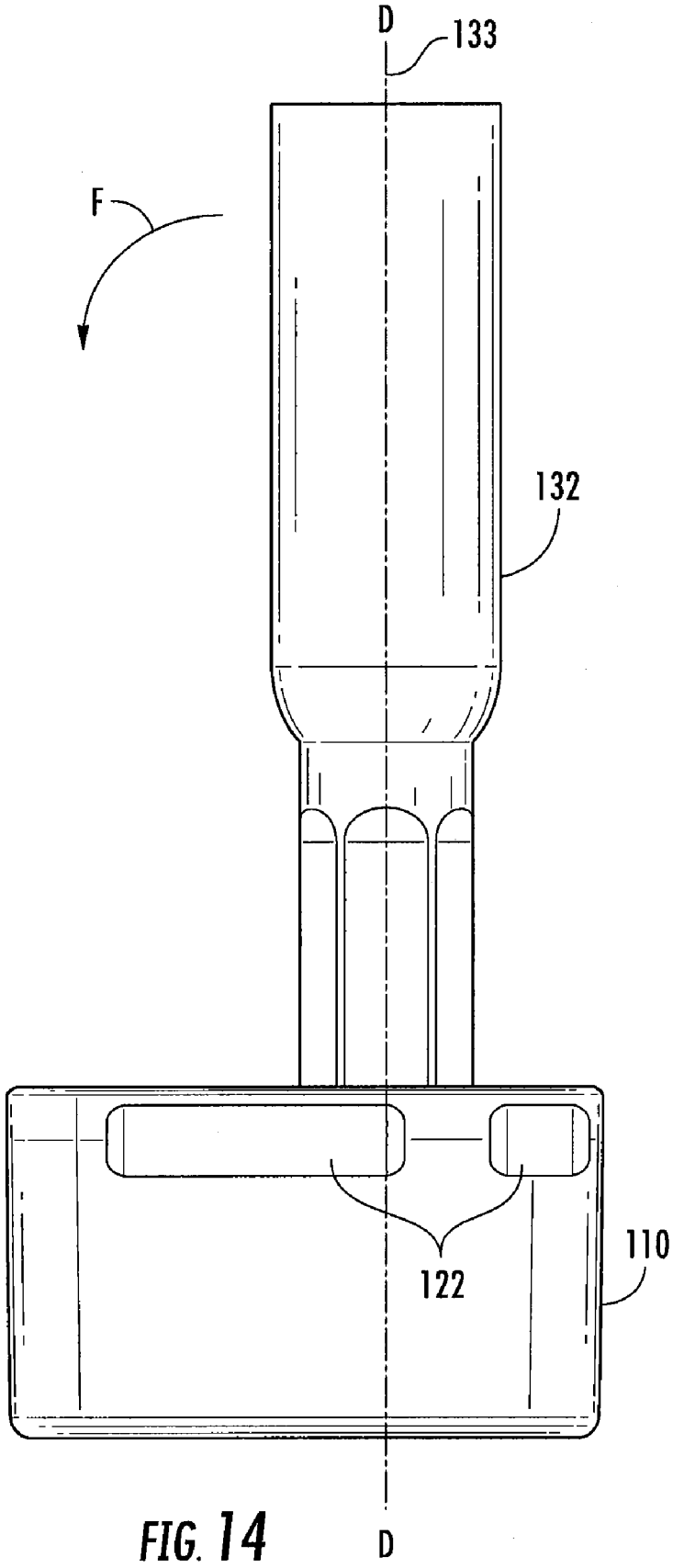
FIG. 14 is a section view of the holder of FIG. 1 with the bit in the first position.
Figure 15:
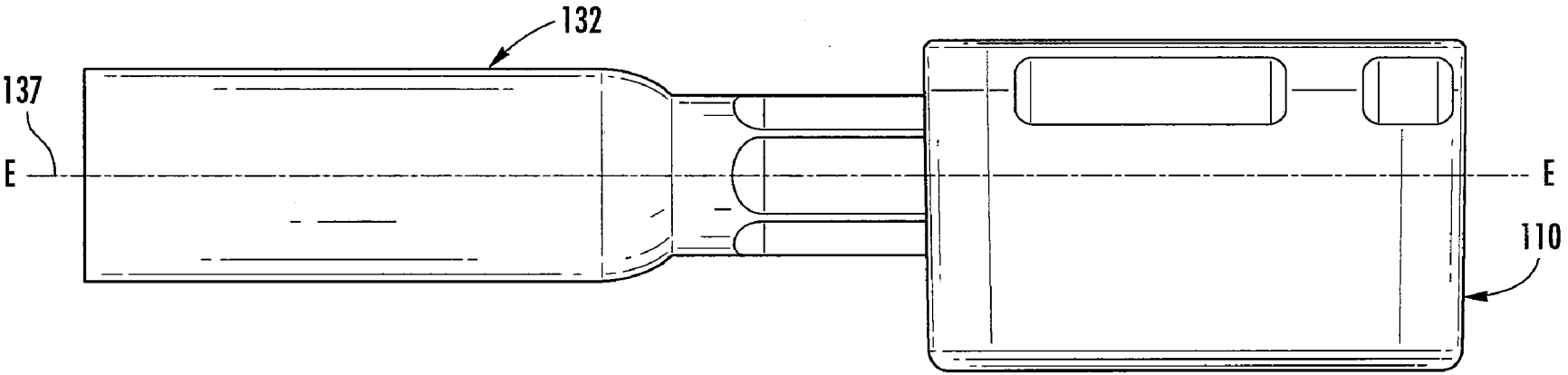
FIG. 15 is a section view of the holder of FIG. 1 with the bit in the second position.

To insert a bit into the holder, a bit 132 is inserted into the holder along the first pathway defined by axis D-D. The bit is properly oriented and guided into the holder by mating side wall 135 and 136. The end of bottom wall 139 is also shaped and configured to closely receive the side of the bit 132 as the bit is inserted into cavity 134 along axis D-D. Referring to FIG. 12, the back wall 136 and the end of bottom wall 139 create a receiver having the same cross-sectional shape as the inserted end of bit 132 such that the bit is guided into the proper location in cavity 134. When the bit is fully inserted into cavity 134 along pathway D-D the lower end of the bit is closely adjacent to or abutting the bottom wall 139 and the side of the bit is closely adjacent to or abutting the back wall 136.

The user pushes against the exposed end of the bit in the direction of arrow F to rotate the bit in cavity 134. Bit 132 is rotated from a position where its longitudinal axis extends along axis D-D to a position where its longitudinal axis is disposed along axis E-E. The side of the bit 132 abuts and pivots about the end of bottom wall 139. As the bit rotates, it is forced between protrusions 140 until it rests against bottom wall 139. The side walls 135 flex away from one another allowing the bit to pass between the protrusions. Once the bit clears the protrusions 140 the side walls 135 of the cavity can flex and return to their normal undeformed state. In this position the space between the protrusions is less than the width of the bit such that the bit is held in the holder. The protrusions 140 and surface 139 create an interference fit with bit 132 to retain the bit in the holder. To remove the bits the process is reversed.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A bit holder comprising:

a body having a top and a bottom defining at least one cavity wherein said cavity is formed at least in part by opposed sidewalls, said cavity comprising a first pathway for receiving a bit wherein said first pathway is formed at least in part by a wall that is dimensioned and shaped to closely receive a bit from the top and includes an extending flexible free end that extends toward the bottom in a cantilevered fashion from said body such that the bit is supported in the first pathway in a first orientation where a longitudinal axis of the bit extends along the axis of the first pathway; and a second pathway for holding a bit wherein the second pathway is defined at least in part by a bottom wall having a flexible free end; said first and second pathways intersecting and defining an open area between said first pathway and said second pathway such that a bit can be rotated between said first pathway and said second pathway, said first pathway being disposed at an angle relative to said second pathway;

protrusions formed on the sidewalls in the open area between the first pathway and the second pathway arranged opposite one another to create a constricted space between the protrusions wherein the sidewalls flex to increase the spacing between the protrusions to allow a bit to pass between the protrusions where the bit is locked in the second pathway in an interference fit.

2. The bit holder of claim 1 wherein said at least one cavity extends through the body.

3. The bit holder of claim 1 wherein the bottom wall extends at an angle relative to said wall.

4. The bit holder of claim 1 wherein the holder includes a plurality of cavities arranged in said body.

5. The bit holder of claim 4 wherein a side wall forms two adjacent of said plurality of cavities, said side wall including an interior space to allow the side wall to flex.

6. The bit holder of claim 1 wherein said angle is 90 degrees.

7. The bit holder of claim 1 wherein said angle is less than 90 degrees.

8. A bit holder comprising;

a case;

a plurality of holders disposed in said case;

each of said bit holders comprising a body having a top and a bottom defining at least one cavity wherein said cavity is formed at least in part by opposed sidewalls, said cavity comprising a first pathway for receiving a bit wherein said first pathway is formed at least in part by a wall that is dimensioned and shaped to closely receive a bit from the top and includes an extending flexible free end that extends toward the bottom in a cantilevered fashion from said body such that the bit is supported in the first pathway in a first orientation where a longitudinal axis of the bit extends along the axis of the first pathway; and a second pathway for holding a bit wherein the second pathway is defined at least in part by a bottom wall having a flexible free end; said first and second pathways intersecting to define an open area between said first pathway and said second pathway such that a bit can be rotated between said first pathway and said second pathway; said first pathway being disposed at an angle relative to said second pathway;

protrusions formed on the side walls in the open area between the first pathway and the second pathway arranged opposite one another to create a constricted space between the protrusions wherein the sidewalls flex to increase the spacing between the protrusions to allow a bit to pass between the protrusions where the bit is locked in the second pathway in an interference fit.

9. The bit holder of claim 8 wherein said case comprises a first section that is movable relative to a second section.

10. The bit holder of claim 9 wherein said first section is hinged to said second section.

11. The bit holder of claim 9 further including a lock for releasably securing the first section to the second section.

12. The bit holder of claim 9 wherein said holders are releasably secured in the case.

13. The bit holder of claim 12 wherein said holders include an end wall at each end of the body, said end walls each including a first mating structure.

14. The bit holder of claim 13 wherein said case includes a second mating structure that is engageable with said first mating structure.

15. The bit holder of claim 14 wherein said holder extends between an opposed pair of said second mating structures such that said first mating structures can engage said second mating structures.

16. The bit holder of claim 14 wherein said first mating structure comprises a protrusion and said second mating structure comprises a recess.

* * * * *